US007721489B1

(12) United States Patent
Inzeo

(10) Patent No.: US 7,721,489 B1
(45) Date of Patent: May 25, 2010

(54) VENTED GUTTER AND FASCIA SYSTEMS

(75) Inventor: Joseph A. Inzeo, West Allis, WI (US)

(73) Assignee: Metal-Era, Inc., Waukesha, WI (US)

( * ) Notice: Subject to any disclaimer, the term of this patent is extended or adjusted under 35 U.S.C. 154(b) by 49 days.

(21) Appl. No.: 11/944,662

(22) Filed: Nov. 26, 2007

Related U.S. Application Data

(60) Provisional application No. 60/941,504, filed on Jun. 1, 2007.

(51) Int. Cl.
*E04D 13/00* (2006.01)

(52) U.S. Cl. ..... 52/95; 52/94; 52/302.3; 52/12; 248/48.2

(58) Field of Classification Search ..... 52/94, 52/95, 96, 97, 302.3, 12; 248/48.1, 48.2; 454/364, 365
See application file for complete search history.

(56) References Cited

U.S. PATENT DOCUMENTS

| | | | | | |
|---|---|---|---|---|---|
| 891,406 | A | * | 6/1908 | Cassens | 210/542 |
| 2,635,841 | A | * | 4/1953 | Bauhammer et al. | 248/48.1 |
| 2,847,949 | A | * | 8/1958 | Pond | 52/12 |
| 2,954,727 | A | * | 10/1960 | Katt et al. | 454/260 |
| 3,098,322 | A | * | 7/1963 | Greene | 52/11 |
| 3,181,275 | A | * | 5/1965 | Wood et al. | 52/73 |
| 3,239,172 | A | * | 3/1966 | Chalmers | 248/48.2 |
| 3,295,803 | A | * | 1/1967 | Blayden | 248/48.2 |
| 3,436,878 | A | * | 4/1969 | Singer | 52/12 |
| 3,555,750 | A | * | 1/1971 | Banse | 52/97 |
| 3,612,453 | A | * | 10/1971 | Zimmer | 248/48.2 |
| 3,683,785 | A | * | 8/1972 | Grange | 454/250 |
| 3,752,428 | A | * | 8/1973 | Trostle et al. | 248/48.2 |
| RE27,761 | E | * | 9/1973 | Attaway | 52/60 |
| 4,037,372 | A | * | 7/1977 | Patry | 52/96 |
| 4,092,808 | A | * | 6/1978 | Maloney et al. | 52/11 |
| 4,195,452 | A | * | 4/1980 | Smith et al. | 52/11 |
| 4,271,643 | A | * | 6/1981 | Sweers | 52/11 |
| 4,347,691 | A | * | 9/1982 | Lloyd-Jones | 52/95 |
| 4,404,777 | A | * | 9/1983 | Lolley et al. | 52/60 |
| 4,419,850 | A | * | 12/1983 | Butzen | 52/60 |
| 4,433,512 | A | * | 2/1984 | Schoener | 52/11 |
| 4,570,396 | A | * | 2/1986 | Struben | 52/90.2 |
| 4,607,566 | A | * | 8/1986 | Bottomore et al. | 454/260 |
| 4,622,789 | A | * | 11/1986 | Quinnell | 52/95 |
| 4,631,875 | A | * | 12/1986 | Olson | 52/12 |
| 4,665,667 | A | * | 5/1987 | Taylor et al. | 52/96 |

(Continued)

*Primary Examiner*—Robert J Canfield
*Assistant Examiner*—Matthew J Gitlin
(74) *Attorney, Agent, or Firm*—Donald J. Ersler

(57) ABSTRACT

A vented gutter system includes a gutter hanger and a ventilation strip. The gutter hanger preferably includes a lengthwise support, a plurality of hanger members and a plurality of mounting plates. Each hanger member includes a roof attachment leg and a fascia attachment member. Each mounting plate is attached to a single fascia attachment member. The plurality of hanger members are attached to the lengthwise support. The ventilation strip is secured to a bottom of the plurality of hanger members. A vented fascia system preferably includes a rear plate, a roof flange, at least two bracket spacers, a fascia plate and a ventilation strip. The roof flange is secured to one side of the bracket spacers and the rear plate is secured to the other side thereof. The ventilation strip is secured to the bracket spacers. The fascia plate is secured to the bracket spacers.

7 Claims, 6 Drawing Sheets

U.S. PATENT DOCUMENTS 4,798,033 A * 1/1989 Weidl ..... 52/94
4,912,888 A * 4/1990 Martin ..... 52/12
4,995,308 A * 2/1991 Waggoner ..... 454/260
5,035,172 A * 7/1991 Waggoner ..... 454/260
5,189,853 A * 3/1993 Braine et al. ..... 52/96
5,272,846 A * 12/1993 Kelley et al. ..... 52/96
5,328,406 A * 7/1994 Morris et al. ..... 454/260
5,345,727 A * 9/1994 McCrea ..... 52/11
5,361,551 A * 11/1994 Post ..... 52/95
5,579,617 A * 12/1996 Schiedegger et al. ..... 52/288.1
5,608,993 A * 3/1997 Argiropoulos ..... 52/96
5,718,085 A * 2/1998 Plum ..... 52/11
5,718,086 A * 2/1998 Dunn ..... 52/95
5,885,153 A * 3/1999 Bateman ..... 454/260
5,927,023 A * 7/1999 Kittilstad ..... 52/60
5,941,028 A * 8/1999 Hicks ..... 52/95
5,996,289 A * 12/1999 Allaster ..... 52/95
6,035,587 A * 3/2000 Dressler ..... 52/97
6,145,255 A * 11/2000 Allaster ..... 52/95
6,412,229 B2 * 7/2002 Kuhns ..... 52/13
6,578,322 B2 * 6/2003 Kintop ..... 52/96
6,745,517 B2 * 6/2004 Vahldieck ..... 52/12
6,751,911 B1 * 6/2004 Gates et al. ..... 52/96
6,845,590 B1 * 1/2005 Mills, Jr. ..... 52/60
D503,225 S * 3/2005 Rodolfo et al. ..... D23/393
D503,227 S * 3/2005 Rodolfo et al. ..... D23/393
6,912,813 B2 * 7/2005 Grizenko ..... 52/58
6,912,814 B1 * 7/2005 Inzeo et al. ..... 52/60
6,922,951 B1 * 8/2005 Inzeo et al. ..... 52/94
6,932,901 B2 * 8/2005 Crosby ..... 210/162
6,955,010 B2 * 10/2005 Martin ..... 52/94
7,059,086 B2 * 6/2006 Edvardsen ..... 52/58
7,104,013 B1 * 9/2006 Gates et al. ..... 52/96
7,143,557 B1 * 12/2006 Ayers, Jr. ..... 52/302.1
7,155,864 B1 * 1/2007 Din ..... 52/11
7,191,566 B2 * 3/2007 Back et al. ..... 52/95
7,278,239 B1 * 10/2007 West ..... 52/12
7,448,167 B2 * 11/2008 Bachman ..... 52/12
7,451,572 B1 * 11/2008 Inzeo et al. ..... 52/60
2001/0017008 A1 * 8/2001 Kuhns ..... 52/11
2002/0043029 A1 * 4/2002 Hikai ..... 52/58
2004/0103592 A1 * 6/2004 Edvardsen ..... 52/58
2004/0163329 A1 * 8/2004 Back et al. ..... 52/94
2004/0244303 A1 * 12/2004 Seise, Jr. ..... 52/12
2005/0000167 A1 * 1/2005 Richard et al. ..... 52/11
2005/0223657 A1 * 10/2005 Brochu et al. ..... 52/94
2006/0174552 A1 * 8/2006 Nocito ..... 52/95
2008/0072503 A1 * 3/2008 Brochu et al. ..... 52/94

* cited by examiner

VENTED GUTTER AND FASCIA SYSTEMS

CROSS-REFERENCES TO RELATED APPLICATIONS

This is a utility patent application taking priority from provisional application No. 60/941,504 filed on Jun. 1, 2007.

BACKGROUND OF THE INVENTION

1. Field of the Invention

The present invention relates generally to venting systems and more specifically to vented gutter and fascia systems, which either combines a gutter hanger with a ventilator or locates a ventilator behind a fascia.

2. Discussion of the Prior Art

U.S. Pat. No. 2,954,727 to Katt et al. discloses a roof ventilator. The Katt et al. patent provides a roof ventilating construction for use at the eaves, which provides necessary air inlet openings into the space between adjacent roof rafters and between the roof and insulation on the interior thereof to assure ventilation of the entire roof structure. U.S. Pat. No. 4,631,875 to Olson discloses a gutter assembly and method of installation. The Olson patent includes a gutter assembly with a leaf guard and soffit strip for attachment along a roof edge. Ventilation openings may be formed through the soffit strip to allow ventilation into a rafter area of a roof.

U.S. Pat. No. 6,932,901 to Crosby discloses a one piece eaves treatment combining rain gutter, leaf screen, drip edge, fascia and soffit vent. The Crosby patent includes a gutter system, which combines a leaf screen, rain gutter, drip edge and soffit vent into a unitary, molded plastic structure. The gutter system forms the fascia along a roof eaves. U.S. Pat. No. 7,143,557 to Ayers, Jr. discloses a structural vent assembly for a roof perimeter. The Ayers Jr. patent includes a structural vent assembly having a back member; a mount member adapted to be secured to a support structure; a front member; and means for attaching the front member to the back and mounting members in a spaced apart relationship.

Accordingly, there is a clearly felt need in the art for vented gutter and fascia systems, which either combines a gutter hanger with a ventilator that may be customized for each application or locates a ventilator behind a fascia.

SUMMARY OF THE INVENTION

The present invention provides a vented gutter hanging system, which either combines a gutter hanger with a ventilator or locates a ventilator behind a fascia. A vented gutter system includes a gutter hanger and a ventilation strip. The gutter hanger preferably includes a lengthwise support, a plurality of hanger members and a plurality of mounting plates. The lengthwise support preferably includes an L-shaped cross section. Each hanger member includes a roof attachment leg, a gutter support leg and a fascia attachment member. Each mounting plate is attached to an end of a single fascia attachment member with any suitable process. The ventilation strip preferably includes a U-shaped cross section. A plurality of perforations are formed through the ventilation strip to allow the flow of air.

The plurality of hangers are attached to the lengthwise support with any suitable method. The ventilation strip is secured to a bottom of the plurality of hanger members with a plurality of fasteners. The vented gutter hanging system is secured to a roof by inserting a plurality of fasteners through the plurality of roof attachment legs into a roof and inserting a plurality of fasteners through the plurality of mounting plates into a fascia board. A gutter is attached to the plurality of gutter support legs and the lengthwise support with a plurality of fasteners. A drip edge is preferably laid over the plurality of roof attachment legs and hooked over an edge of the gutter. A plurality of fasteners are inserted through the drip edge into the roof.

A vented fascia system preferably includes a rear plate, a roof flange, at least two bracket spacers, a fascia plate and a ventilation strip. A fastening lip extends from a bottom edge of the rear plate. The roof flange includes a roof attachment leg and a vertical leg extending downward from an end of the roof attachment leg. Each bracket spacer includes a rear mounting leg, a front mounting leg and a middle leg. The rear mounting leg extends from one end of the middle leg and the front mounting leg extends from the other end of the middle leg in a direction opposite that of the rear mounting leg. A snap clip extends from a bottom of the fascia plate to retain a snap flange extending from an end of the ventilation strip.

An open ended roof truss will require the attachment of an angle to provide an attachment surface. The rear plate and the rear mounting legs of the at least two bracket spacers are attached to an end of a roof truss or to the angle with a plurality of fasteners. The roof attachment leg of the roof flange is attached to a roof sheathing with a plurality of fasteners. The vertical leg of the roof flange is attached to the front mounting legs of the at least two bracket spacers with a plurality of fasteners. The ventilation strip is attached to the fastening lip with a plurality fasteners. The snap flange of the ventilation strip is retained in the snap clip of the fascia plate. The fascia plate is secured to the vertical leg and the front mounting legs of the at least two bracket spacers with a plurality of fasteners.

Accordingly, it is an object of the present invention to provide a vented gutter system, which combines a gutter hanger and a ventilator that may be adapted for each application.

Finally, it is another object of the present invention to provide a vented fascia system, which locates a ventilator behind a fascia.

These and additional objects, advantages, features and benefits of the present invention will become apparent from the following specification.

DETAILED DESCRIPTION OF THE PREFERRED EMBODIMENTS

Figure 1:
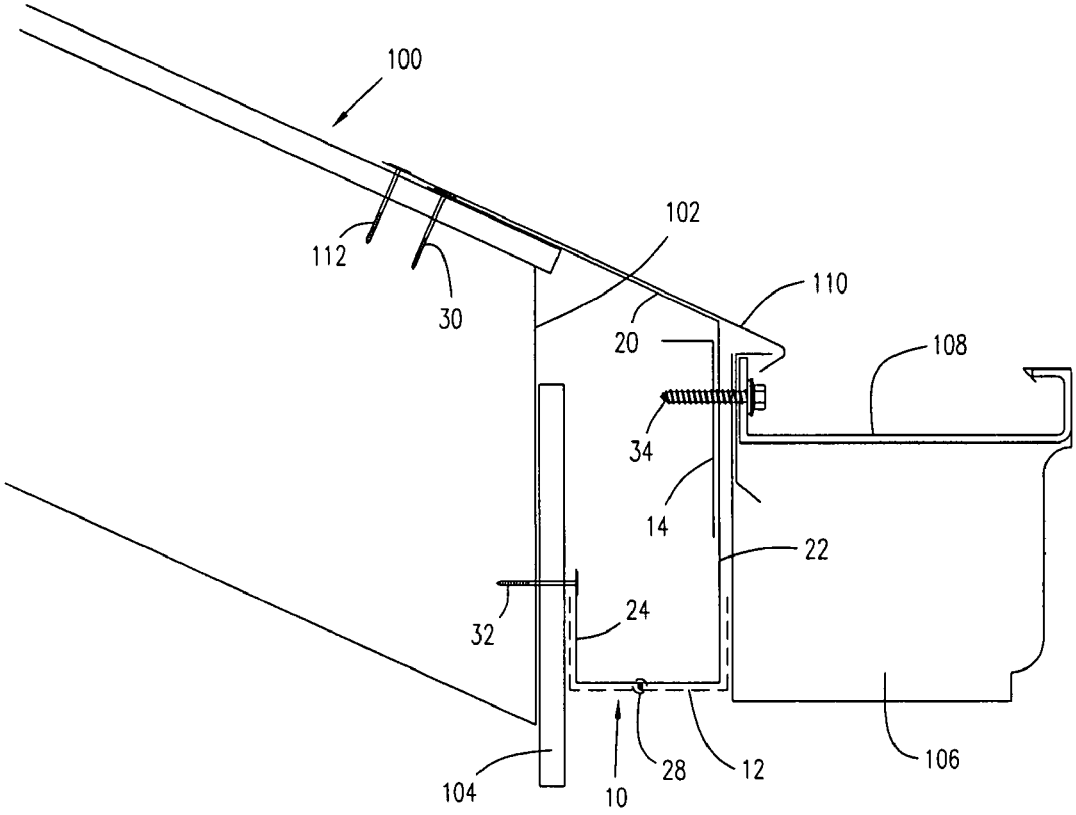
FIG. 1 is an end view of a vented gutter system with a gutter secured thereto and attached to a structure in accordance with the present invention.
Figure 2:
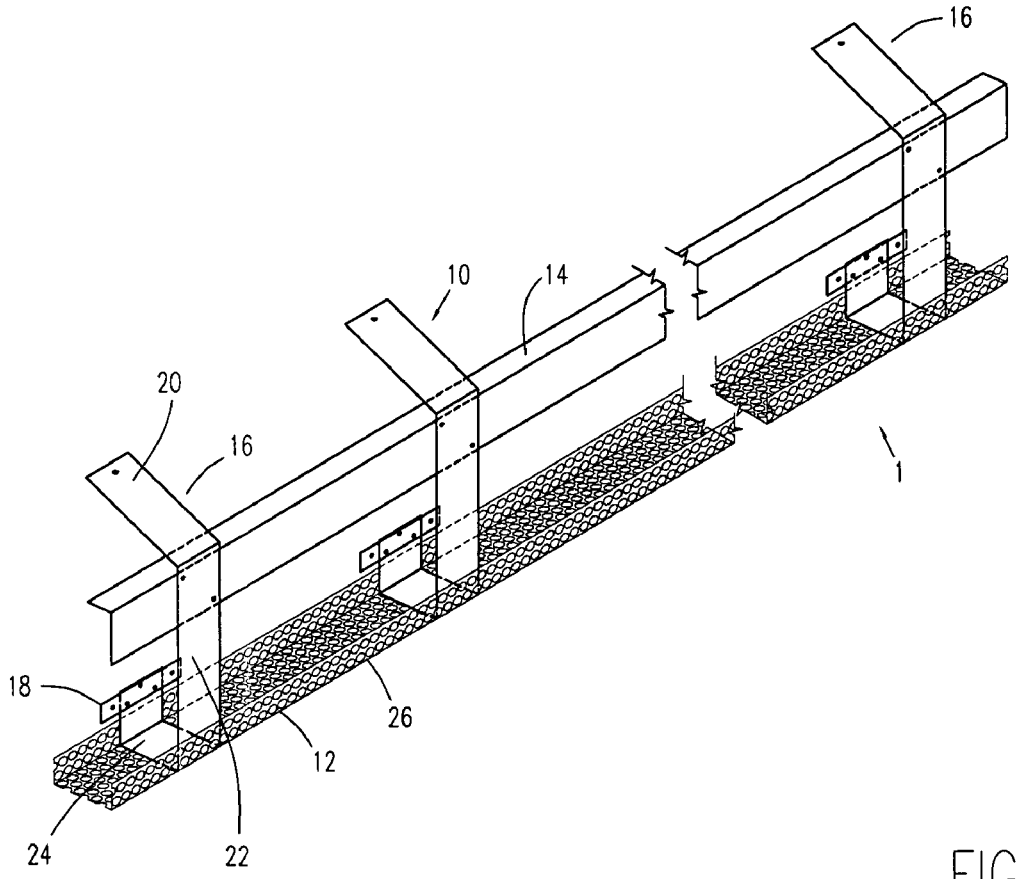
FIG. 2 is a perspective view of a vented gutter system in accordance with the present invention.
Figure 3:
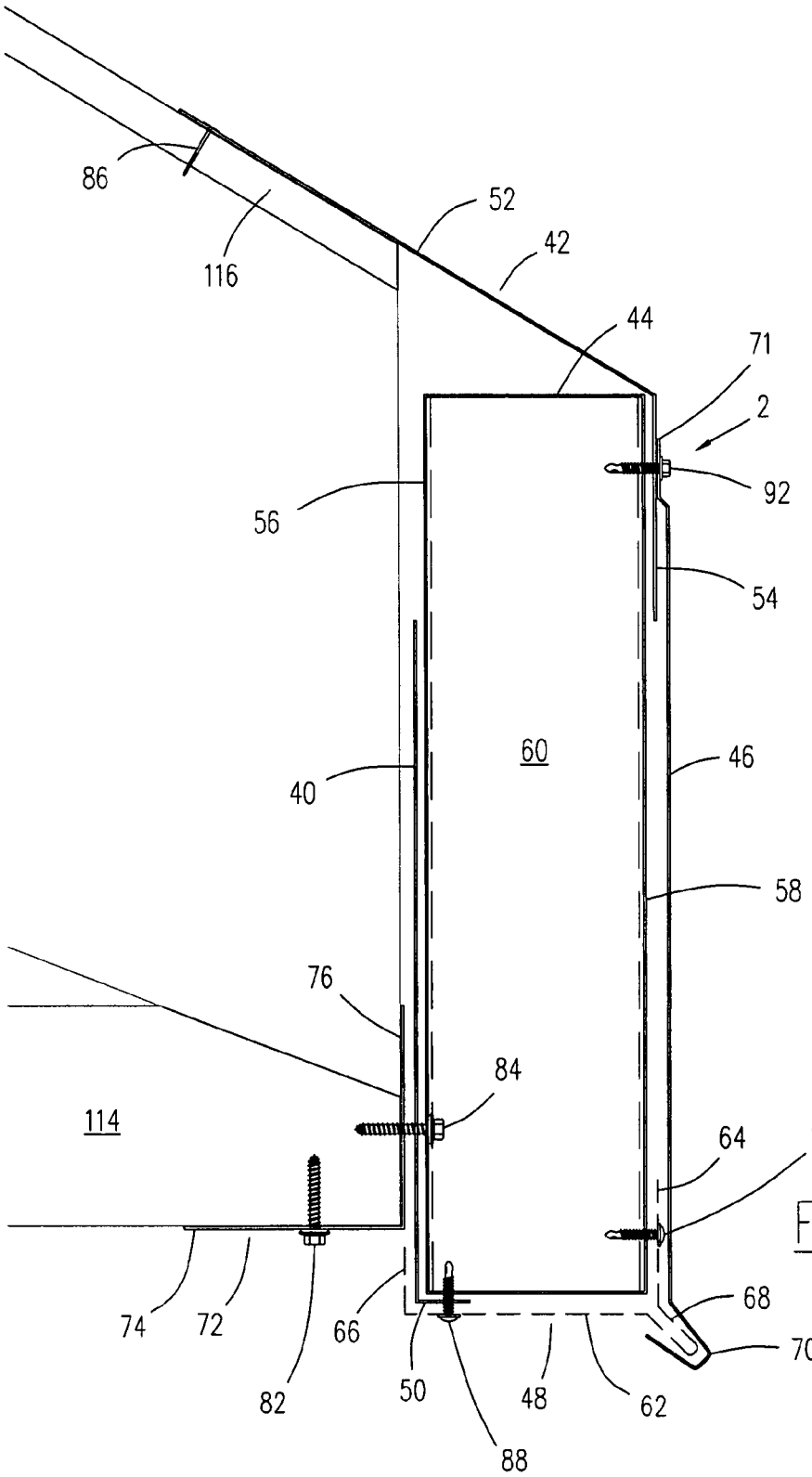
FIG. 3 is an end view of a vented fascia system attached to a structure in accordance with the present invention.
Figure 4:
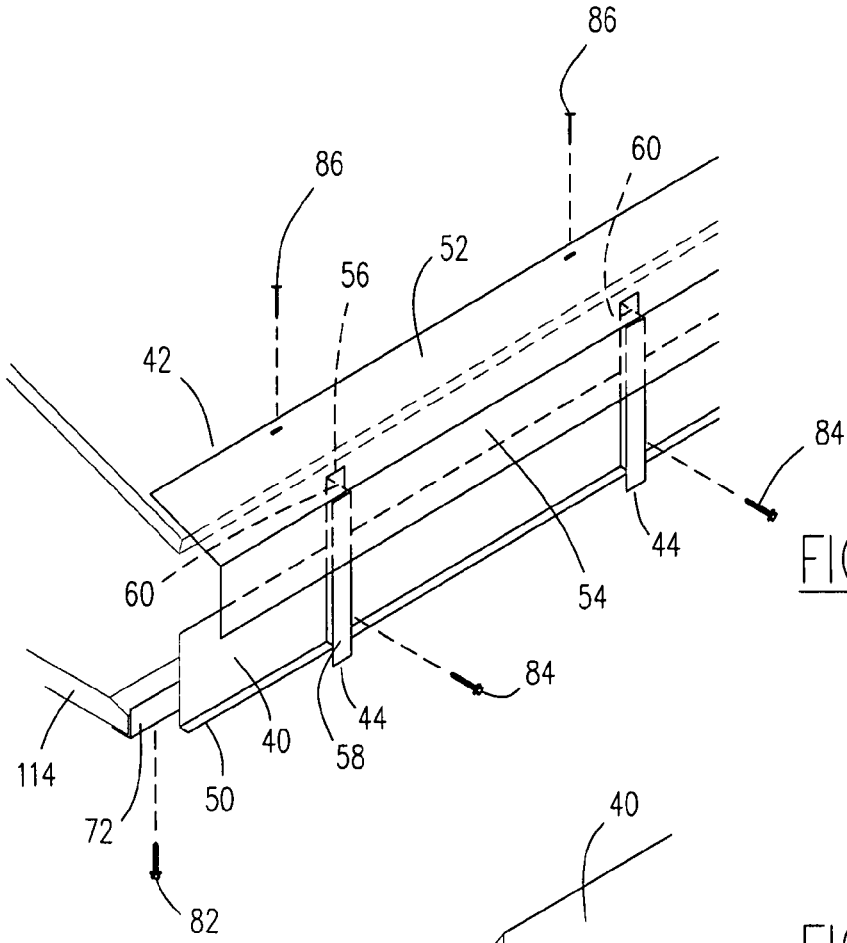
FIG. 4 is a perspective view of a partially assembled vented fascia system attached to a structure in accordance with the present invention.
Figure 5:
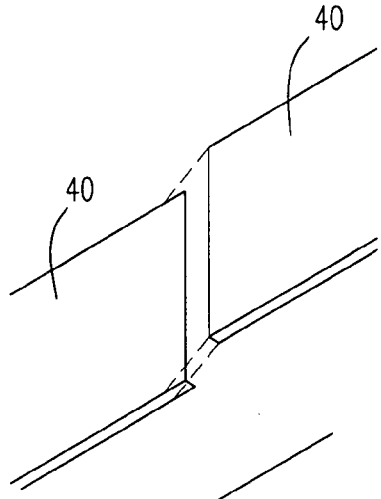
FIG. 5 is a perspective view of two adjacent rear plates of a vented fascia system in accordance with the present invention.

With reference now to the drawings, and particularly to FIG. 2, there is shown a perspective view of a vented gutter hanging system 1. With reference to FIG. 1, the vented gutter hanging system 1 includes a gutter hanger 10 and a ventilation strip 12. The gutter hanger 10 preferably includes a lengthwise support 14, a plurality of hanger members 16 and a plurality of mounting plates 18. The lengthwise support 14 preferably includes an L-shaped cross section for rigidity and strength.

Each hanger member 16 includes a roof attachment leg 20, a gutter support leg 22 and a fascia attachment member 24. The roof attachment leg 20 extends from one end of the gutter support leg 22 and a fascia attachment member 24 extends from the other end thereof. Each roof attachment leg 20 may be bent relative to the gutter support leg 22 at nearly any angle to accommodate different roof pitches. The fascia attachment member 24 has an L-shaped cross section. Each mounting plate 18 is attached to an end of the single fascia attachment member 24 with metal locking, welding or any other suitable process. The ventilation strip 12 preferably includes a U-shaped cross section, but other cross sectional shapes may also be used. A plurality of perforations 26 are formed through the ventilation strip 12 to allow the flow of air in to a roof vent opening 102 of a roof 100.

The plurality of hangers 16 are attached along a length of the lengthwise support 14 with metal locking, welding, a plurality of fasteners or any other suitable method. The ventilation strip 12 is secured to a bottom of the plurality of fascia attachment members 24 with a plurality of fasteners 28. The vented gutter hanging system 1 is secured to the roof 100 by inserting a plurality of fasteners 30 through the plurality of roof attachment legs 20 into the roof 100 and inserting a plurality of fasteners 32 through the plurality of mounting plates 18 into a fascia board 104. A gutter 106 including a plurality of gutter straps 108 are attached to the gutter support leg 22 and the lengthwise support 14 with a plurality of fasteners 34. A drip edge 110 is laid over the plurality of roof attachment legs 20 and hooked over an edge of the gutter 106. A plurality of fasteners are inserted through the drip edge 110 into the roof 100.

The vented gutter hanging system 1 may be sold with the plurality of hanger members 16 attached to the lengthwise support and the ventilation strip 12 attached to the plurality of hanger members 16. The vented gutter hanging system 1 may also be sold without the assembly of hanger members 16, lengthwise support 14 and ventilation strip 12. In either case, the plurality of mounting plates 18 would be attached to the plurality of hanger members 16.

Figure 6:
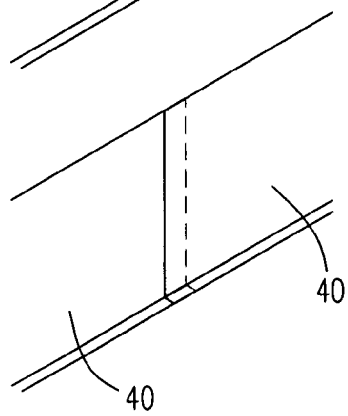
FIG. 6 is a perspective view of two rear plates overlapping each other of a vented fascia system in accordance with the present invention.

With reference to FIGS. 3-8, a vented fascia system 2 preferably includes a rear plate 40, a roof flange 42, at least two bracket spacers 44, a fascia plate 46 and a ventilation strip 48. A fastening lip 50 extends from a bottom edge of the rear plate 40. Two adjacent rear plates 40 are preferably overlapped as shown in FIG. 6 when installed on a structure. The roof flange 42 includes a roof attachment leg 52 and a vertical leg 54 extending downward from an end of the roof attachment leg 52. Each bracket spacer 44 includes a rear mounting leg 56, a front mounting leg 58 and a middle leg 60. The rear mounting leg 56 preferably extends substantially perpendicular from one end of the middle leg 60 and the front mounting leg 58 extends preferably substantially perpendicular from the other end of the middle leg 60 in a direction opposite that of the rear mounting leg 56.

A plurality of perforations 55 are formed through the ventilation strip 48 to allow the flow of air. The ventilation strip 48 includes a vent base 62, a front flange 64, a rear flange 66 and a snap flange 68. The front flange 64 extends upward from a front end of the vent base 62 and the rear flange 66 extends upward from a rear end of the vent base 62. The snap flange 64 extends outward from a junction of the front flange 64 and the vent base 62. A snap clip 70 is formed on a bottom of the fascia plate 46 and an offset leg 71 is formed on a top of the fascia plate 46. The snap clip 70 is sized to receive the snap flange 68 of the ventilation strip 48.

Figure 9:
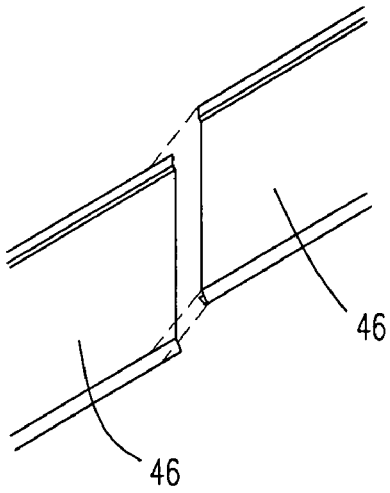
FIG. 9 is a perspective view of two adjacent fascia plates of a vented fascia system in accordance with the present invention.
Figure 10:
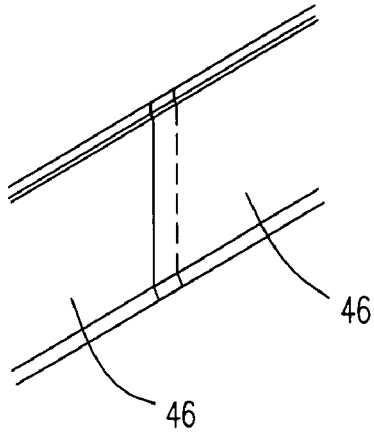
FIG. 10 is a perspective view of two fascia plates overlapping each other of a vented fascia system in accordance with the present invention.
Figure 11:
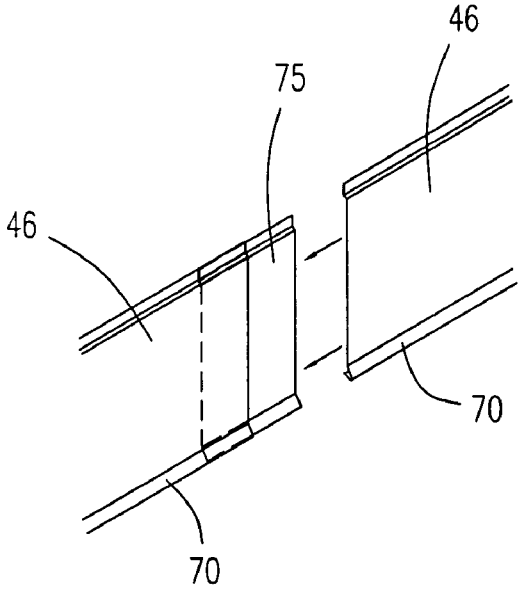
FIG. 11 is a perspective view of two fascia plates assembled to each other with a fascia splice of a vented fascia system in accordance with the present invention.

With reference to FIGS. 9-11, two adjacent fascia plates 46 may be overlapped or a fascia splice 75 may be used to join the two adjacent fascia plates 46. The fascia splice 75 includes substantially the same profile as the fascia plates 46. A bottom of the fascia splice 75 is inserted into the snap clip 70 and is sized to receive a rear of the fascia plates 46. An open ended roof truss 114 will require the attachment of an angle 72 to provide an attachment surface for the vented fascia system 2. The angle 72 includes a first leg 74 and a second leg 76, which extends from the first leg 74.

The vented fascia system 2 is preferably assembled to a structure in the following manner. If an open ended roof truss 114 is used, the angle 72 must be attached thereto. A plurality of first fasteners 82 are threaded through the first leg 74 and into a bottom of the open ended roof truss 114. The second leg 76 provides an attachment surface for a bottom of the rear plate 40 and the at least two brackets spacers 44. The rear plate 40 and the rear mounting legs 56 of the at least two bracket spacers 44 are attached to an end of the roof truss 114 or to the second leg 76 of the angle 72 with a plurality of fasteners 84. The roof attachment leg 52 of the roof flange 42 is attached to a roof sheathing 116 with a plurality of fasteners 86.

Figure 7:
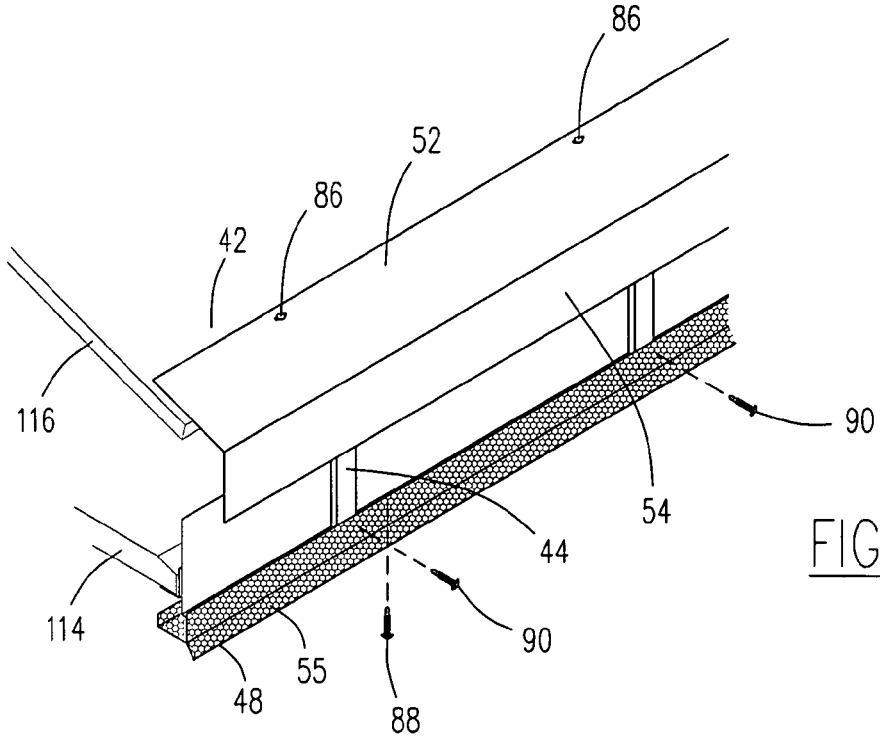
FIG. 7 is a perspective view of a partially assembled vented fascia system attached to a structure with the addition of a ventilation strip in accordance with the present invention.
Figure 8:
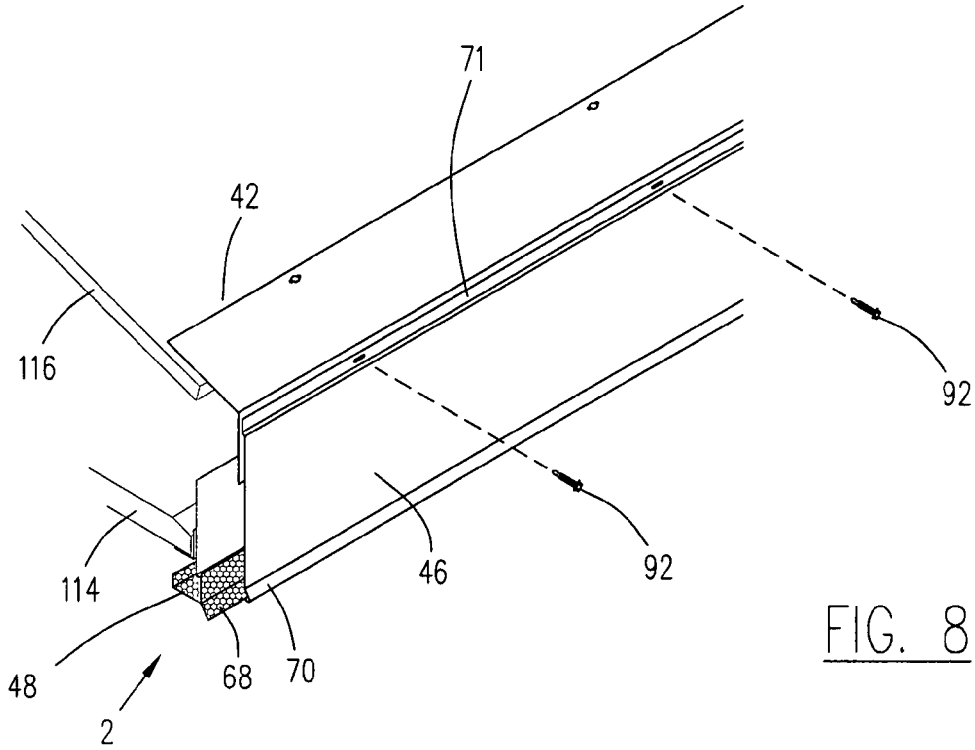
FIG. 8 is a perspective view of a vented fascia system attached to a structure in accordance with the present invention.

With reference to FIG. 7, the vent base 62 of the ventilation strip 48 is attached to the fastening lip 50 with a plurality of fasteners 88. The front flange 64 of the ventilation strip 48 is attached to the front mounting legs 58 with a plurality of fasteners 90. With reference to FIG. 8, the snap flange 68 of the ventilation strip 48 is inserted into the snap clip 70 of the fascia plate 46. The vertical leg 54 of the roof flange 42 and the offset leg 71 of the fascia plate 46 are attached to the front mounting legs 58 of the at least two bracket spacers 44 with a plurality of fasteners 92.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A vented gutter hanging system comprising:

at least one rear plate extending substantially a length of said vented gutter hanging system;

a roof flange including a roof attachment leg and a vertical leg, said vertical leg extending downward from an end of said roof attachment leg, said roof attachment leg is secured to a roof;

at least two bracket spacers, each one of said at least two bracket spacers including a rear mounting leg, a front mounting leg and a middle leg, said rear mounting leg extending from one end of said middle leg, said front mounting leg extending from the other end of said middle leg, said front and rear mounting legs being substantially parallel to each other, said vertical leg being attached to said front mounting leg, said at least one rear plate being attached to said rear mounting leg, said front and rear mounting legs being disposed between said vertical leg and said at least one rear plate, a fascia plate being attached to said front of said at least two bracket spacers, a snap clip being formed on a bottom of said fascia plate; and a ventilation strip being disposed on a bottom of said at least two bracket spacers, said ventilation strip extending substantially a length of said vented gutter hanging system, said ventilation strip including a plurality of openings, a snap flange extending outward from a bottom of said ventilation strip, said snap flange being sized to be received by said snap clip.

2. The vented gutter hanging system of claim 1, further comprising:

a fastening lip extending outward from said rear plate toward said at least two spacer brackets.

3. A vented gutter hanging system comprising:

at least one rear plate extending substantially a length of said vented gutter hanging system;

a roof flange including a roof attachment leg and a vertical leg, said vertical leg extending downward from an end of said roof attachment leg, said roof attachment leg is secured to a roof;

at least two bracket spacers, each one of said at least two bracket spacers including a rear mounting leg, a front mounting leg and a middle leg, said rear mounting leg extending from one end of said middle leg, said front mounting leg extending from the other end of said middle leg, said front and rear mounting legs being substantially parallel to each other, said vertical leg being attached to said front mounting leg, said at least one rear plate being attached to said rear mounting leg, said front and rear mounting legs being disposed between said vertical leg and said at least one rear plate, said vertical leg not extending below a bottom of said at least two bracket spacers, a fascia plate being attached to said front of said at least two bracket spacers, a snap clip being formed on a bottom of said fascia plate; and a ventilation strip being disposed on a bottom of said at least two bracket spacers, said ventilation strip extending substantially a length of said vented gutter hanging system, said ventilation strip including a plurality of openings, a snap flange extending outward from a bottom of said ventilation strip, said snap flange being sized to be received by said snap clip.

4. The vented gutter hanging system of claim 3, further comprising:

a fastening lip extending outward from said rear plate toward said at least two spacer brackets.

5. The vented gutter hanging system of claim 3, further comprising:

an angle for attachment to an open ended truss, said rear plate being attached to said angle.

6. Vented gutter hanging system comprising:

at least one rear plate extending substantially a length of said vented gutter hanging system;

a roof flange including a roof attachment leg and a vertical leg, said vertical leg extending downward from an end of said roof attachment leg, said roof attachment leg is secured to a roof;

at least two bracket spacers, each one of said at least two bracket spacers including a rear mounting leg, a front mounting leg and a middle leg, said rear mounting leg extending from one end of said middle leg, said front mounting leg extending from the other end of said middle leg, said front and rear mounting legs being substantially parallel to each other, said vertical leg being attached to said front mounting leg, said at least one rear plate being attached to said rear mounting leg, said front and rear mounting legs being disposed between said vertical leg and said at least one rear plate, a fastening lip extending outward from said rear plate toward said at least two spacer brackets; and a fascia plate being attached to said front of said at least two bracket spacers, a snap clip being formed on a bottom of said fascia plate; and a ventilation strip being disposed on a bottom of said at least two bracket spacers, said ventilation strip extending substantially a length of said vented gutter hanging system, said ventilation strip including a plurality of openings, a snap flange extending outward from a bottom of said ventilation strip, said snap flange being sized to be received by said snap clip.

7. The vented gutter hanging system of claim 6, further comprising:

an angle for attachment to an open ended truss, said rear plate being attached to said angle.

* * * * *

UNITED STATES PATENT AND TRADEMARK OFFICE

CERTIFICATE OF CORRECTION

PATENT NO. : 7,721,489 B1
APPLICATION NO. : 11/944662
DATED : May 25, 2010
INVENTOR(S) : Joseph A. Inzeo It is certified that error appears in the above-identified patent and that said Letters Patent is hereby corrected as shown below:

Column 4, line 61, reads: "1. A vented gutter hanging system";
it should read: --1. A vented fascia system--.

Column 5, line 22, reads: "2. The vented gutter hanging system";
it should read: --2. The vented fascia system--.

Column 5, line 26, reads: "3. A vented gutter hanging system";
it should read: --3. A vented fascia system--.

Column 6, line 6, reads: "4. The vented gutter hanging system";
it should read: --4. The vented fascia system--.

Column 6, line 10, reads: "5. The vented gutter hanging system";
it should read: --5. The vented fascia system--.

Column 6, line 14, reads: "6. A vented gutter hanging system";
it should read: --6. A vented fascia system--.

Column 6, line 44, reads: "7. The vented gutter hanging system";
it should read: --7. The vented fascia system--.

Signed and Sealed this

Twenty-ninth Day of June, 2010

David J. Kappos

David J. Kappos
*Director of the United States Patent and Trademark Office*